United States Patent [19]

Cruchon et al.

[11] Patent Number: 4,853,657

[45] Date of Patent: Aug. 1, 1989

[54] ORTHOGONAL-POLARIZATION DUPLEX SEND-RECEIVE MICROWAVE HEAD

[75] Inventors: Jean-Claude Cruchon, Bouffemont; Franck Fontaine, Nogent Sur Marne; Michel Brugidou, Le Vesinet, all of France

[73] Assignee: Societe anonyme dite: Alcatel Thomson Faisceaux Hertziens, Cedex, France

[21] Appl. No.: 207,564

[22] Filed: Jun. 16, 1988

[30] Foreign Application Priority Data

Jun. 18, 1987 [FR] France ..... 87 08520

[51] Int. Cl.[4] ..... H01P 1/161; H01P 5/16

[52] U.S. Cl. ..... 333/137; 333/21 A; 370/32

[58] Field of Search ..... 333/117, 125, 126, 135, 333/137, 21 A; 370/24, 32; 455/81, 82, 90

[56] References Cited

U.S. PATENT DOCUMENTS

| | | | |
|---|---|---|---|
| 2,810,904 | 10/1957 | Blitz | 455/81 X |
| 2,897,457 | 7/1959 | Marie . | |
| 2,961,618 | 11/1960 | Ohm | 333/137 |
| 3,086,203 | 4/1963 | Hutchison | 455/81 X |
| 3,162,828 | 12/1964 | Schmidt et al. | 333/137 |
| 4,516,089 | 5/1985 | Goscianski et al. . | |

FOREIGN PATENT DOCUMENTS

| | | |
|---|---|---|
| 0110324 | 6/1984 | European Pat. Off. . |
| 3111106 | 9/1982 | Fed. Rep. of Germany . |
| 2591406 | 6/1987 | France . |

*Primary Examiner*—Paul Gensler

*Attorney, Agent, or Firm*—Sughrue, Mion, Zinn, Macpeak & Seas

[57] ABSTRACT

An orthogonal polarization duplex send-receive microwave head comprising an elongate housing (10) provided at one end (26) with a longitudinal bore (25) forming a first waveguide and with a transverse bore (28) forming a second waveguide opening out into the first waveguide, and an antenna (44) which extends into the first waveguide, said microwave head being characterized in that said antenna (44) is a receive antenna which extends into said first waveguide at a location situated between the inside end of said first waveguide (25) and the location at which said second waveguide (28) opens out therein, and in that a transmit antenna (45) extends into the second waveguide at its free end, with said antennas being connected to respective coaxial accesses (41, 42) and with a metal plate (31) being disposed longitudinally in the first waveguide between two tranverse planes containing the two antennas (44, 45).

8 Claims, 2 Drawing Sheets

ORTHOGONAL-POLARIZATION DUPLEX SEND-RECEIVE MICROWAVE HEAD

The invention relates to an orthogonal-polarization duplex send-receive microwave head.

BACKGROUND OF THE INVENTION

It is currently common practice to use duplexers in all microwave link systems. The vast majority of them make use of waveguide accesses at two different polarities, or else they make use of coaxial accesses on rectangular or square horns. They are generally based on the principle that an over-size waveguide is capable of propagating two waves at orthogonal polarizations (this applies in particular to a circular or a square TE 11 waveguide).

The electromagnetic fields are separated by a mode filtering effect (for example using a decoupling plate which puts one of the types of propagation below a cut-off) in combination with lengths of waveguide.

In principle, a good quality duplexer provides 40 dB to 50 dB of decoupling between accesses, and it must be made as a waveguide at all of its accesses for the purpose of preserving the distribution of the electromagnetic fields. This principle is always used because of its greater fidelity in reproduction and its improved symmetry.

In present-day international competition, data transmission systems include retransmission via satellites operating in communication with cheap miniature ground stations. TV retransmission by such systems appears to be headed for great expansion.

Technical progress, for example in the following fields:

monolithic circuit manufacture using silicon (Si) or gallium arsenide (GaAs);

automatic wiring of circuits using surface mounting components; and computer-assisted circuit design;

makes it possible, cheaply and on a large scale, to achieve reliable semiconductor circuits of the following types: high power amplifiers (HPA); low noise amplifiers (LNA); and low noise converters (LNC).

In this case, competition resides in the mechanical environment which makes use of cast metal boxes and also of hybrid or composite technologies.

U.S. Pat. No. 4,156,089 describes a system for receiving linear orthogonal polarized microwave signals, which system is essentially constituted, after a parabolic reflector, by a receive horn, a bandpass filter, a mode separator, and a housing containing electronic circuits for amplification and frequency conversion. The horn and the filter are made as waveguides and, together with the mode separator and the housing, are carried by a common support constituted by two half-shells which are symmetrical about their longitudinal assembly plane and which are suitable for being manufactured by a common industrial method, in particular a method such as casting or injecting a metal or a plastic material which is subsequently metallized.

However, in such a system, the connection between the portion made of waveguide and the electronic circuits is provided by subdividing the separator into two waveguides of orthogonal rectangular right cross-sections; with these two waveguides being coupled to two respective circuit support plates.

Such an implementation prevents a high degree of integration because of the existence of problems of field deformation by coupling between the orthogonally polarized microwave signals.

The object of the present invention is to mitigate these drawbacks.

SUMMARY OF THE INVENTION

To this end, the present invention provides an orthogonal polarization duplex send-receive microwave head comprising an elongate housing provided at one end with a longitudinal bore forming a first waveguide and with a transverse bore forming a second waveguide opening out into the first waveguide, and an antenna which extends into the first waveguide, wherein said antenna is a receive antenna which extends into said first waveguide at a location situated between the inside end of said first waveguide and the location at which said second waveguide opens out therein, and wherein transmit antenna extends into the second waveguide at its free end, with said antennas being connected to respective coaxial accesses and with a metal plate being disposed longitudinally in the first waveguide between two transverse planes containing the two antennas.

Advantageously, such a head is suitable for composite waveguide-coax integration. The overall embodiment is greatly simplified by combining these two techniques.

More particularly, the present invention provides a microwave head comprising a cylindrically or semicylindrically shaped housing formed with concentric pins acting as a radiator, which pins are machined at a first end of said housing in order to form three flats, with the first two flats being a top flat and a parallel bottom flat, and with the third flat being perpendicular thereto. An oblong cavity for receiving a respective circuit is formed in each of said three flats. The third flat is connected to the other two flats via a succession of parallel orifices for containing link wires between the various circuits. Each of these three cavities communicates with the first end of the housing via a corresponding orifice. The first and second cavities disposed on either side of said longitudinal bore communicate therewith respectively via a first cylindrically shaped transverse bore and via a second bore constituting the second waveguide.

Such a head offers numerous advantageous mechanical characteristics:

a single housing moldable under pressure;

access to the power supply and amplification functions via the cavities; and a high degree of compactness (usable at the focus of an antenna).

It also provides numerous advantageous electrical characteristics:

send-receive decoupling of better than 45 dB;

an inlet noise temperature of less than 150° K when using the new high electron mobility transistors (HEMT) and three stages of amplification for the low noise amplifier (LNA) circuits and the low noise converter (LNC) circuits; and an effective power of 1 watt to 2 watts for the high power amplifier (HPA).

Finally, it provides advantageous thermal characteristics:

dissipated heat is removed by natural convection from the finned body and by conduction to the excitation support or supporting bracket.

BRIEF DESCRIPTION OF THE DRAWINGS

An embodiment of the invention is described by way of example with reference to the accompanying drawings, in which.

MORE DETAILED DESCRIPTION

Figures 1, 2, 3, 4, 5:
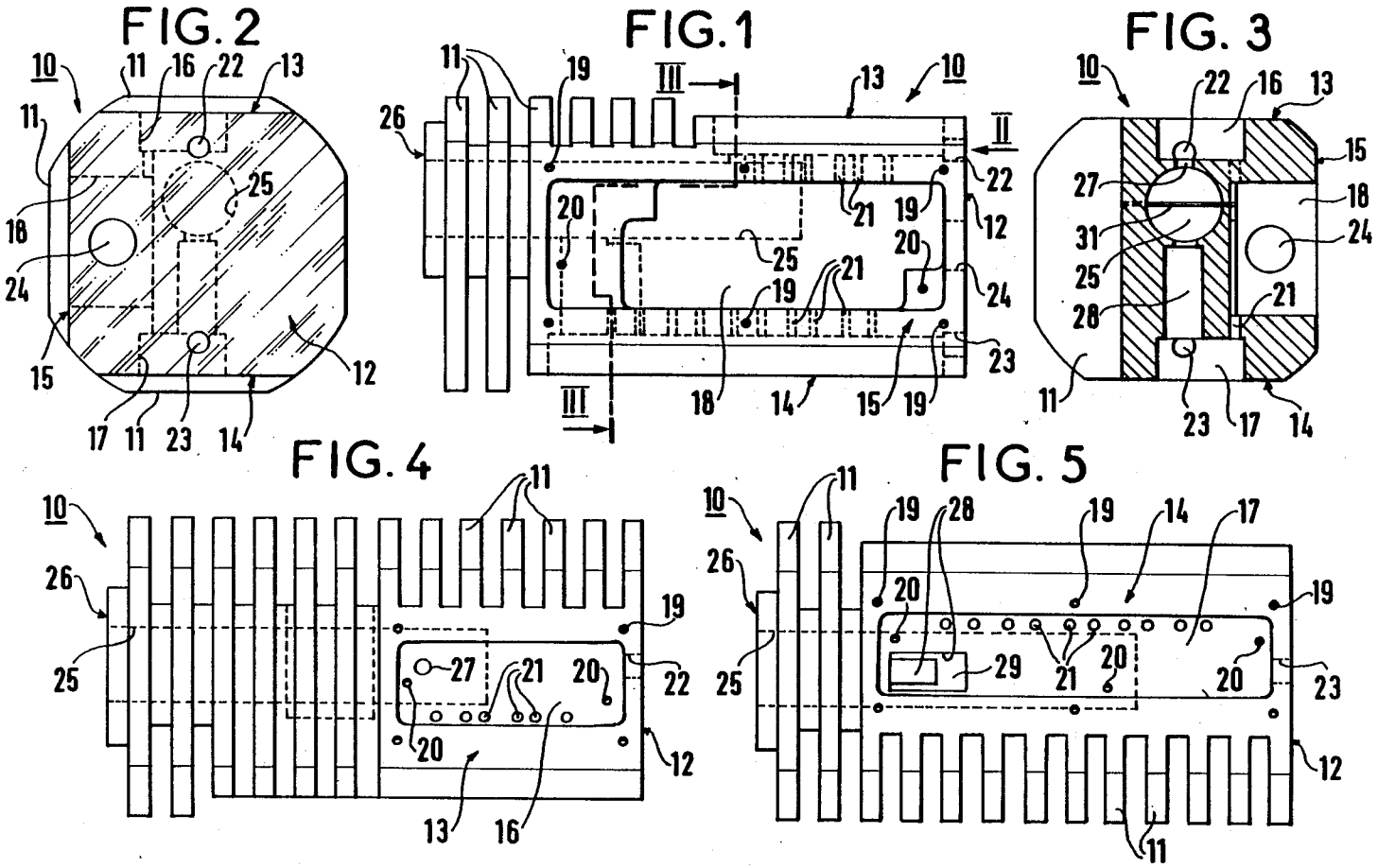
FIG. 1 is a front view of a microwave head in accordance with the invention.
FIG. 2 is an end view along arrow II of FIG. 1.
FIG. 3 is a section on III—III of FIG. 1.
FIG. 4 is a top plan view.
FIG. 5 is a bottom plan view.

The microwave head in accordance with the invention comprises a housing as shown in FIGS. 1 to 5.

The housing 10 is cylindrical or semi-cylindrical in shape and is formed with concentric fins 11 acting as a radiator, with said fins being machined at a first end 12 of the housing 10 in order to form three flats, with the first two flats 13 and 14 being a top flat and a bottom flat and being parallel with each other, and with the third flat 15 being perpendicular thereto.

Each of these three flats 13, 14, and 15 has a respective oblong cavity 16, 17, 18 formed therein.

Each of these three flats includes holes 19 enabling a plane cover to be fixed thereon.

The three cavities 16, 17, and 18 also include holes 20 enabling each of them to have a circuit fixed therein.

The third cavity 18 is connected ot the other two via a succession of parallel orifices 21 for containing link wires between the various circuits.

These three cavities 16, 17, and 18 communicate with the first end 12 of the housing 10 via three respective orifices 22, 23, and 24.

A longitudinal cylindrical bore 25 is machined in the housing to open out at the second end 26 of the housing so as to form a first TE 11 mode waveguide.

The first and second cavities 16 and 17 disposed on either side of said bore 25 communicate therewith respectively via a first transverse bore 27 which is cylindrical in shpae and a second transverse bore 28 which is rectangular in shape and which is partially closed adjacent to the first longitudinal bore by an iris 29 in order to constitute an iris compensated TE 10 mode rectangular waveguide.

A polarization plate 31 divides the first cavity along a mid-plane in the longitudinal direction and it is situated between the first and second transverse bores 27 and 28. This plate serves to short-circuit that one of the electric fields which is parallel thereto.

Figure 6:
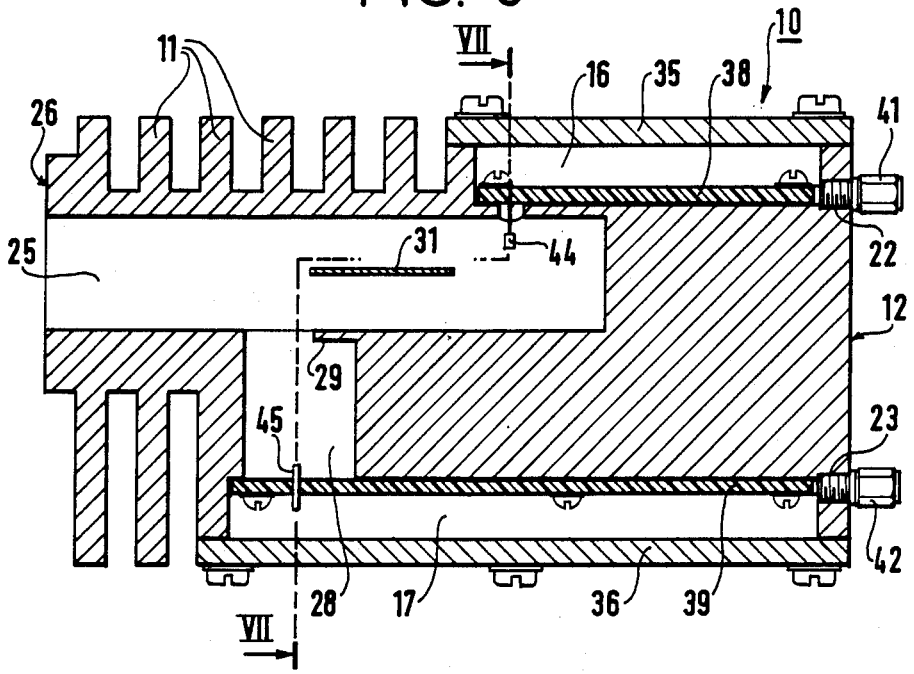
FIG. 6 is a section view of the microwave head in accordance with the invention on a vertical plane VI—VI of FIG. 7.
Figure 7:
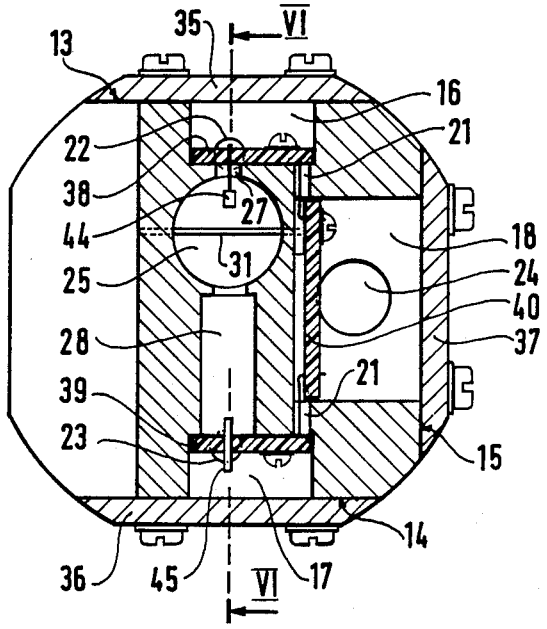
FIG. 7 is a cross-sectional view of a microwave head in accordance with the invention on a plane VII—VII of FIG. 6.

The head in accordance with the invention is shown in FIGS. 6 and 7 after being assembled.

Each of the cavities 16, 17, and 18 is closed by a respective plane cover 35, 36, and 37 resting on a respective one of the three flats 13, 14, and 15, thereby constituting respective electromagnetically screened enclosures.

The cavities contain the following circuits respectively:

the first cavity 16 contains a receive circuit 38;

the second cavity 17 contains a send circuit 39; and the third cavity 18 contains a power supply circuit 40 for the other two circuits 37 and 38.

Each of these three circuits is connected to a connector fixed in one of the orifices 22, 23, and 24, with the first two connectors being coaxial connectors 41 and 42, and with the third connector not being shown in the figures.

The receive circuit 38, e.g. a low noise converter (LNC) type circuit, is a circuit for amplifying a receive signal and it includes an antenna 44 passing through the first transverse bore 27 so as to have its receive portion per se disposed in the longitudinal bore 25.

The transmit circuit 39, e.g. a high power amplifier (HPA) type of circuit is a circuit for amplifying a transmit signal and it includes an antenna 45 located in the second transverse bore 28. This circuit closes said transverse bore 28.

The third circuit 40 feeds electricity to the components of the other two circuits 38 and 39, and in particular to the transistors thereof, by means of wires which pass through the orifices 21.

A microwave head in accordance with the invention may cooperate with an excitation horn mounted on the second end of the housing 10 and situated in the extension of the longitudinal waveguide 25, such a horn being well-known to the person skilled in the art and not being shown in the figures.

A metal sole plate acting as a ground plane may be disposed on the housing side face of each of the circuits 38, 39, and 40.

A microwave head in accordance with the invention thus consists in a composite integrated system for transmitting and receiving orthogonal polarizations and having the following characteristics, in particular:

a duplex source having a high degree of decoupling (greater than 50 dB) by virtue of its composite disposition (coaxial antenna in a cylindrical TE 11 mode waveguide 25 and an iris compensated TE 10 mode rectangular guide 28);

a receive amplifier circuit 38 mounted directly in the cast duplexer body, said receiver amplifier circuit 38 being provided with an antenna 44 giving it direct access to the cylindrical waveguide 25; and a transmit amplifier circuit 39 mounted directly in the cast duplexer body, said transmit amplifier circuit 30 being provided with an antenna 45, closing the transmit waveguide 28, and providing the coax-to-waveguide transition.

The head assembly constitutes a sealed block which forms a heat radiator suitable for outdoor or indoor mounting at the focus of a parabolic antenna or offset by means of a corrugated or trap bipolar circular source.

The invention relates to the composite disposition of the duplexer associated with the transmit and receive amplifier circuits, while simultaneously acting as a radiator of the energy consumed without transmission link losses and having a very low receive noise temperature.

A particular embodiment of a head in accordance with the invention has the following characteristics:

Physical dimensions:

length: 130 mm outside diameter: 72 mm first cavity:

diameter: 17.8 mm; and depth: 91 mm;

rectangular opening:

cross-section: 19 mm×9.5 mm; and depth: 22 mm.

Materials used:

the housing 10 may be conventionally machined in metal, for example light alloy, or it may be a plastic molded under pressure and then metallized, e.g. metallized epoxy;

the circuits may be made, for example, on Duroid or on Teflon glass which is 0.254 mm thick and disposed on a rigid metal sole plate which is not less than 2 mm thick.

Performance:

The following frequency bands may be used:

receive: 10.95 GHz to 12.75 GHz; and transmit: 14.0 GHz to 14.5 GHz.

Naturally, the present invention has been described and shown purely by way of preferred example and its component parts could be replaced by equivalent parts without thereby going beyond the scope of the invention.

Thus, the iris 29 for providing matching between the first guide 25 and the second guide 28 could be replaced by a post.

The longitudinal bore could be square or rectangular, in which case it would still propagate TE 11 mode.

The second guide 28 could be square or rectangular: in which case it would propagate TE 10 mode, or else it could be circular, in which case it would propagate TE 11 mode.

We claim:

1. An orthogonal polarization duplex send-receive microwave head comprising: an elongate housing provided at one end with a longitudinal bore extending partially through said housing and terminating in an inside end and forming a first waveguide, a transverse bore forming a second waveguide having a free end and an end opening out into the first waveguide, a receive antenna situated in said first waveguide at a location between the inside end of said first waveguide and the location at which said second waveguide opens out therein, a transmit antenna situated in the second waveguide at said free end, a coaxial connector connected respectively to each of said antennas, and a metal plate disposed longitudinally in the first waveguide between two transverse planes containing the two antennas.

2. A microwave heading according to claim 1, wherein the housing is a cylindrical or semi-cylindrical housing having concentric fins formed thereon serving as a radiator and machined at a first end of the housing to form three flats including a first top flat and a second bottom flat parallel to each other, and a third flat perpendicular thereto, said three flats having respectively, first, second and third oblong cavities formed therein to receive a circuit, said third cavity being connected to the other two cavities via a succession of parallel orifices for containing link wires between the various circuits, said three cavities communicating with the first end of the housing via three respective orifices, said first and second cavities being disposed on either side of the longitudinal bore and communicating therewith respectively via a first transverse bore which is cylindrical in shape and a second transverse bore which constitutes the second waveguide.

3. A microwave head according to claim 2, wherein each cavity is closed by a respective plane cover.

4. A microwave head according to claim 1, wherein the longitudinal bore forming the first waveguide is cylindrical so as to propagate in TE 11 mode.

5. A microwave head according to claim 1, wherein the second waveguide is a rectangular waveguide compensated by an iris.

6. A microwave head according to claim 2, including:

a receive circuit situated in the first cavity;

a transmit circuit situated in the second cavity; and a power supply circuit for the receive and transmit circuits situated in the third cavity;

each of said three circuits being connected to a connector, with the receive and transmit circuits being connected to said coaxial connectors.

7. A microwave head according to claim 1, wherein the housing is made of machined metal.

8. A microwave head according to claim 1, wherein the housing is made of molded material having a metal deposit formed thereon.

* * * * *